US005700996A

United States Patent [19]

Lee et al.

[11] Patent Number: 5,700,996

[45] Date of Patent: Dec. 23, 1997

[54] INDUCTION COOKER WITH POWER SWITCHING CONTROL

[75] Inventors: Hae-Don Lee; Jong-Sub Shin, both of Suwon, Rep. of Korea

[73] Assignee: Samsung Electronics Co., Ltd., Kyungki-Do, Rep. of Korea

[21] Appl. No.: 447,556

[22] Filed: May 23, 1995

[30] Foreign Application Priority Data

Jun. 9, 1994 [KR] Rep. of Korea ..... 94-12981

[51] Int. Cl.[6] ..... H05B 6/08

[52] U.S. Cl. ..... 219/626; 219/665; 219/663

[58] Field of Search ..... 219/625, 626, 219/663, 664, 665

[56] References Cited

U.S. PATENT DOCUMENTS

| | | | |
|---|---|---|---|
| 4,145,592 | 3/1979 | Mizukawa et al. | 219/665 |
| 4,467,165 | 8/1984 | Kiuchi et al. | 219/664 |
| 4,540,866 | 9/1985 | Okuda | 219/664 |
| 4,764,652 | 8/1988 | Lee | 219/664 |
| 4,810,847 | 3/1989 | Ito | 219/626 |
| 4,820,891 | 4/1989 | Tanaka et al. | 219/626 |
| 5,376,775 | 12/1994 | Lee | 219/665 |

FOREIGN PATENT DOCUMENTS

| | | | |
|---|---|---|---|
| 3-114196 | 5/1991 | Japan | 219/626 |

*Primary Examiner*—Philip H. Leung

[57] ABSTRACT

The present invention relates to an induction heating cooker for supplying a predetermined resonant current to a heating coil to thereby carry out a cooking operation, the induction heating cooker including: a rectifying unit for full wave rectifying a commercial alternating current, a zero voltage detecting unit for detecting a zero potential of the commercial alternating current, a control unit for synchronizing with the zero potential of the commercial alternating current detected by the zero voltage detecting unit to thereby control the overall operations of the induction heating cooker, a variable frequency oscillating unit for receiving a control signal generated by the control unit to thereby generate an oscillating frequency, an inverter driving unit for generating a driving signal to thereby drive the switching element according to the oscillating frequency generated by the variable frequency oscillating unit, an inverter for receiving the direct current voltage generated from the rectifying unit according to the driving signal of the inverter driving unit to thereby generate a high frequency wave, a current detecting unit for detecting a current intensity change applied to the heating coil to thereby supply a predetermined intensity of resonant current to the heating coil driven by the inverter, and a comparison unit for comparing an input current intensity change of the heating coil detected by the current detecting unit with a reference current intensity previously established by a load setting unit to thereby generate and send a comparison voltage signal to a variable frequency oscillating unit, so that the oscillating frequency can be varied.

3 Claims, 4 Drawing Sheets

V
θ

ON

ON

100kHz
20~30 kHz
16kHz

OFF

OFF

INDUCTION COOKER WITH POWER SWITCHING CONTROL

BACKGROUND OF THE INVENTION

1. Field

The present invention relates to an induction heating cooker in which a predetermined intensity of resonance current is supplied to a heating coil to thereby perform the cooking.

2. Description of the Related Art

Generally, a conventional induction heating cooker is disclosed in Japanese Patent Laid-open Publication Sho 56-123686.

The induction heating cooker disclosed in the above Japanese Patent Laid-open Publication Sho 56-123686, as illustrated in FIG. 1, includes rectifying means 100 for full wave rectifying a commercial alternating current ("AC") voltage input from an AC power input terminal 1 to a direct current ("DC"), inverter means 110 for receiving the current generated from the rectifying means 100 to thereby generate a high frequency wave signal, inverter control means 120 for generating a driving signal in order to turn on or turn off a switching element TR1 and to control an overall operation of the induction heating cooker, and input current detecting means 130 for detecting an input current of the AC power input terminal changing in the course of driving of the heating coil 65 to thereby generate the same to the inverter control means 120 so that the current input to the heating coil 65 driven by the inverter means 110 can be detected.

In the induction heating cooker thus constructed, when a user turns on an operating switch (not shown), the commercial AC voltage input from the AC power input terminal 1 is full wave rectified to a DC voltage by a bridge rectifier 101 of the rectifying means 100.

Ripple components contained in the DC voltage full wave rectified by the bridge rectifier 101 are filtered by a smoothing capacitor C1 and the DC voltage filtered thereby is charged in the smoothing capacitor C1.

At this time, when a synchronizing control signal generated from the inverter control means 120 is applied to a base terminal of the switching element TR1 at the inverter means 110, the switching element TR1 is rendered conductive and, as a result, a current generated by the voltage charged in the smoothing capacitor C1 flows via a closed circuit which is formed by the heating coil 65, switching element TR1, resonant capacitor C2.

Accordingly, the resonant current flows in the heating coil and an eddy current is generated by the resonant current on a surface of a cooking utensil 66 disposed at heating coil 65, thereby starting to heat the cooking utensil 66.

However, in the induction heating cooker thus constructed, there is a problem in that one switching element is used in the inverter means for driving the heating coil to thereby generate a high level of resonant voltage, so that, in case of 220 V commercial AC voltage which is supplied from the AC power input terminal, a switching speed of the switching element slows down, to increase an inner pressure thereof and to thereby invite a possibility of destructing the switching element, and to be unable to guarantee safety of the cooker.

SUMMARY

Accordingly, the present invention is invented to solve the aforementioned problems, and it is an object of the present invention to provide an induction heating cooker by which a current intensity change applied to the heating coil can be detected by current detecting means, to thereby enable the same to supply a predetermined intensity of resonant current to the heating coil for cooking even during a change of input current voltage.

It is another object of the present invention to provide an induction heating cooker by which a surge current flowing in a resonant capacitor through the switching element during an initial operation thereof is made small, so that the switching element and the heating coil can be prevented from being destructed and at the same time, safety of the cooker can be guaranteed.

It is still another object of the present invention to provide an induction heating cooker by which a resonant current flowing in the heating coil is detected by a resonant current detecting unit, to thereby vary an oscillating frequency when a non-metallic cooking utensil is used for stability of output power, thereby leading to stable driving of the cooker.

In accordance with the objects of the present invention, there is provided an induction heating cooker, the cooker comprising:

rectifying means for full wave rectifying to a direct current voltage a commercial alternating current voltage input from an alternating current power input terminal;

zero voltage detecting means for detecting a zero potential of the commercial alternating current voltage input from the alternating current power input terminal;

control means for synchronizing with the zero potential of the commercial alternating current voltage detected by the zero voltage detecting means to thereby control the overall operations of the induction heating cooker;

variable frequency oscillating means for receiving a control signal generated by the control means to thereby generate an oscillating frequency;

inverter driving means for generating a driving signal to thereby drive the switching element according to the oscillating frequency generated by the variable frequency oscillating means;

inverter means for receiving the direct current voltage generated from the rectifying means according to the driving signal of the inverter driving means to thereby generate a high frequency wave;

current detecting means for detecting a current intensity change applied to the heating coil to thereby supply a predetermined intensity of resonant current to the heating coil driven by the inverter means; and comparison means for comparing an input current intensity change of the heating coil detected by the current detecting means with a reference current intensity previously established by load setting means to thereby generate a comparison voltage signal to the variable frequency oscillating means, so that the oscillating frequency can be varied.

BRIEF DESCRIPTION OF THE DRAWINGS

For fuller understanding of the nature and objects of the invention, reference should be made to the following detailed description taken in conjunction with the accompanying drawings in which:

FIGS. 4A through 4G are output waveform diagrams for each part in FIG. 3, wherein;

FIG. 4A is an alternating current waveform diagram at point "A" in FIG. 3;

FIG. 4B is an output waveform diagram at point B in FIG. 3;

FIG. 4C is an output waveform diagram at point C in FIG. 3 when an operation switch is turned on;

FIG. 4D is an output waveform diagram at point D in FIG. 3 when the operation switch is turned on;

FIG. 4E is an output waveform diagram at point E in FIG. 3 when the operation switch is turned on;

FIG. 4F is an output waveform diagram at point C in FIG. 3 when the operation switch is turned off; and FIG. 4G is an output waveform diagram at point D in FIG. 3 when the operation switch is turned off.

DETAILED DESCRIPTION

The embodiment of the present invention will now be described in detail with reference to the accompanying drawings.

Figure 1:
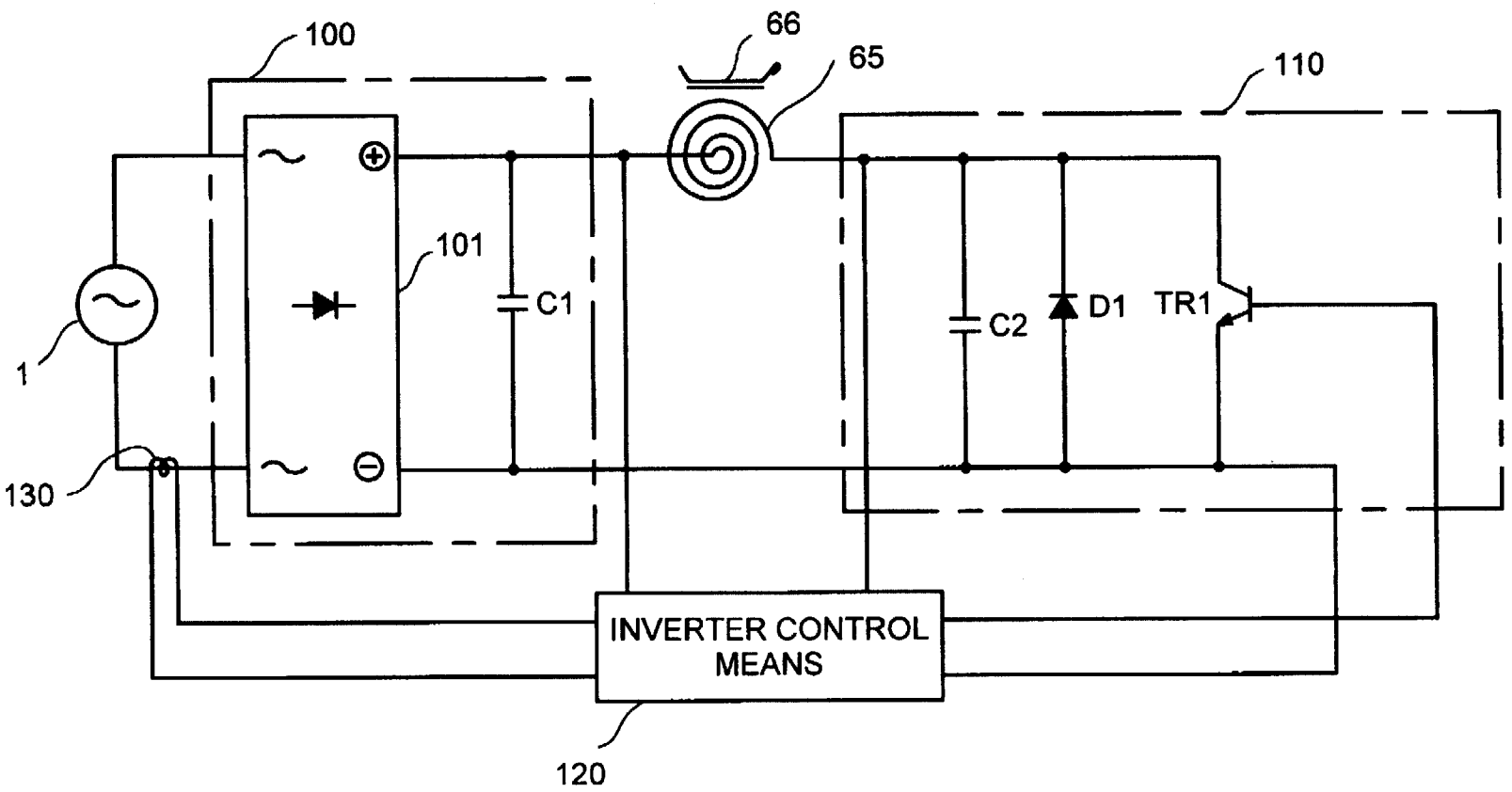
FIG. 1 (PRIOR ART)
FIG. 1 is a schematic diagram for illustrating a control circuit of a conventional induction heating cooker.
Figure 2:
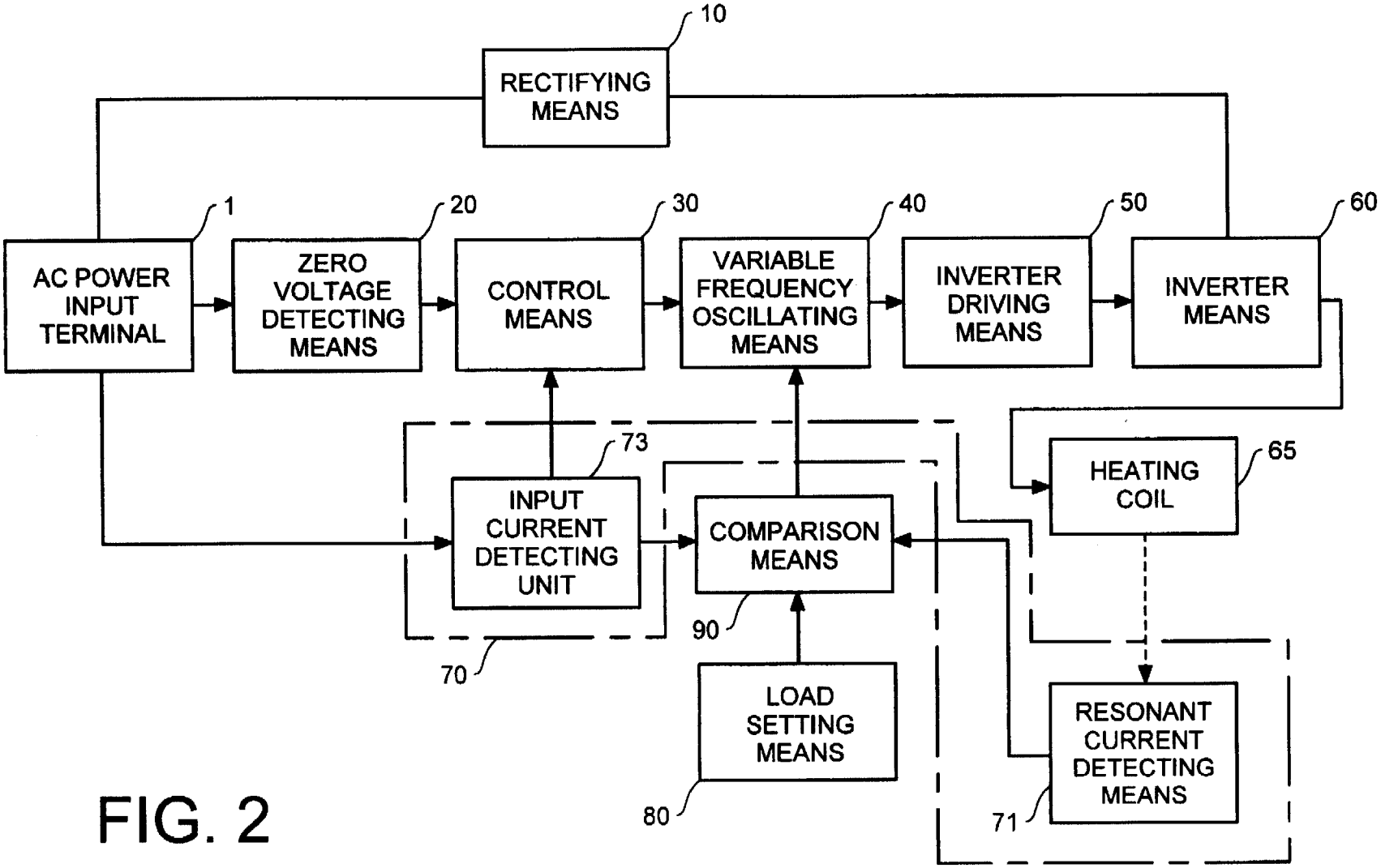
FIG. 2 is a control block diagram of an induction heating cooker according to an embodiment of the present invention.

As illustrated in FIG. 2, the rectifying means 10 serves to full wave rectify to a direct current the commercial alternating current voltage input from an AC power input terminal 1, where the rectifying means 1 includes:

- a bridge rectifier 11 for full wave rectifying to a direct current the commercial AC voltage input from the AC power input terminal 1;
- a smoothing capacitor C1 for being connected to an output terminal of the bridge rectifier 11 to thereby filter ripple components contained in the DC voltage full wave rectified by the bridge rectifier 11 and at the same time to charge the DC voltage full wave rectified therefrom; and
- A choke coil L1 connected at one side thereof to the bridge rectifier 11 and connected at the other side thereof to the smoothing capacitor C1, to thereby increase a rectifying efficiency of the bridge rectifier 11.

The zero voltage detecting means 20 serves to detect a zero potential of the commercial AC power input from the AC power input terminal 1, and the control means 30 is a microcomputer which serves to receive the zero voltage detecting signal output from the zero voltage detecting means 20 to thereby synchronize the zero potential of the commercial AC power, so that the induction heating cooker can be rendered operative or inoperative, and the overall operating of the induction heating cooker can be controlled.

Furthermore, the variable frequency oscillating means 40 serves to receive the control signal generated from the control means 30 to thereby oscillate a predetermined variable frequency so that the oscillating frequency can be varied according to the heating coil 65, wherein the variable frequency oscillating means 40 includes a frequency oscillating unit 41 for receiving a synchronous control signal output from the control means 30 to thereby generate an oscillating frequency varied according to the heating coil 65, a normal frequency holding unit 42 for receiving the synchronous control signal generated from the control means 30 to thereby decrease the voltage applied to the frequency oscillating unit 41 so that the oscillating frequency generated from the frequency oscillating unit 41 can maintain a normal frequency state, and a minimum frequency holding unit 43 for maintaining a minimum frequency of the frequency oscillating unit 41 and for preventing the frequency oscillating unit 41 from going below an audible frequency.

Inverter driving means 50 is adapted to generate a driving signal to base terminals of the switching elements TR1 and TR2 in order to alternatively turn on or turn off the switching elements TR1 and TR2 of the inverter means (described later) according to the variable frequency oscillated from the variable frequency oscillating means 40.

Inverter means 50 serves to receive a DC voltage input from the rectifying means 10 according to the driving signal generated from the inverter driving means 50 to thereby generate a high frequency signal, wherein the inverter means 60 includes switching elements TR1 and TR2 for receiving the driving signal output from the inverter driving means 50 to thereby turn on and/or turn off alternatively so that the resonant current can be generated at the heating coil 65, resonant capacitors C2 and C3 connected in parallel to the switching elements TR1 and TR2 for receiving a voltage charged in the smoothing capacitor C1 of the rectifying means during activation and/or deactivation of the switching elements TR1 and TR2 and for charging and/or discharging so that a voltage source can be formed, voltage dividing resistors R1 and R2 for being connected to the resonant capacitors C2 and C3 in order to reduce surge currents flowing in the resonant capacitors C2 and C3, so that the switching elements TR1 and TR2 and the heating coil 65 can be protected, and protective diodes D1 and D2 connected in parallel to collector terminals and emitter terminals of the switching elements TR1 and TR2 respectively so that reverse electromotive force generated in the deactivation of the switching elements TR1 and TR2 can be bypassed to thereby protect the switching elements TR1 and TR2.

Meanwhile, the heating coil 65 is adapted to have one side thereof connected to a contact between the switching elements TR1 and TR2 in order to generate an eddy current to the cooking utensil 66 according to the full wave alternating current generated by activation and/or deactivation of the switching elements TR1 and TR2, so that the food in the cooking utensil 66 can be heated, whereby the other side thereof is connected in series to a contact between the resonant capacitors C2 and C3.

Current detecting means 70 serves to detect a current intensity change applied to the heating coil driven by the inverter means 60, wherein the current detecting means 70 includes a resonant current detecting unit 71 for detecting the resonant current changing in the heating coil 65 so that a predetermined resonant current can be supplied to the heating coil 65 driven by the inverter means 60, and an input current detecting unit 73 for detecting the current intensity changing in the AC power input terminal 1 to thereby generate the same to the control means 30, so that a discrimination can be made as to whether the cooking utensil 66 disposed on the heating coil 65 is an appropriate utensil.

A resonant current detecting unit 71 includes a current transformer CT1 for detecting resonant current intensity change of the heating coil 65 driven by the inverter means 60, a resistor R3 for being connected in parallel to a secondary side of the current transformer in order to convert to a voltage, the resonant current intensity change detected by the current transformer CT1, a diode D3 for receiving the voltage signal converted by the resistor R3 to full wave rectify the same, and a resistor R6 and a capacitor C4 to one side thereof being connected to a cathode terminal of the diode D3 while the other side thereof being connected to ground, so that ripple components contained in the DC voltage full wave rectified by the diode D3 can be filtered.

Furthermore, the input current detecting unit 73 includes a current transformer CT2 for receiving a commercial AC voltage generated from the AC power input terminal 1 to thereby detect an input current intensity change of the power input terminal 1 changing in the course of the driving of the heating coil 65, a resistor R4 for being connected in parallel to a secondary side of the current transformer CT2 so that the input current intensity change detected by the current transformer CT2 can be converted to voltage, a bridge rectifier 731 for full wave rectifying to a direct current the voltage signal converted by the resistor R4, and a resistor R5 and a capacitor C5 for being connected in parallel to an output terminal of the bridge rectifier 731 so that the ripple components contained in the DC voltage full wave rectified by the bridge rectifier 731 can be filtered.

Load setting means 80 is a variable resistor VR for establishing a current limit which is a reference current intensity of the heating coil so that a predetermined resonant current can be supplied to the heating coil driven by the inverter means 60, and establishes the current limit according to a product specification when a manufacturer sends out a product to the market.

Comparison means 90 in the drawing is a comparator adapted to receive at a non-inverting terminal (+) thereof a voltage signal proportionate to the current intensity change input to the heating coil 65 and detected by the current detecting means 70, and at the same time, to receive at an inverting terminal (–) thereof the reference voltage signal where the current limit is established by the load setting means 80, to thereby compare the same, so that voltage supplied to the variable frequency oscillating means 40 can be varied.

Reference numeral 5 is an operation switch adapted to turn on or turn off the induction heating cooker.

Figure 3:
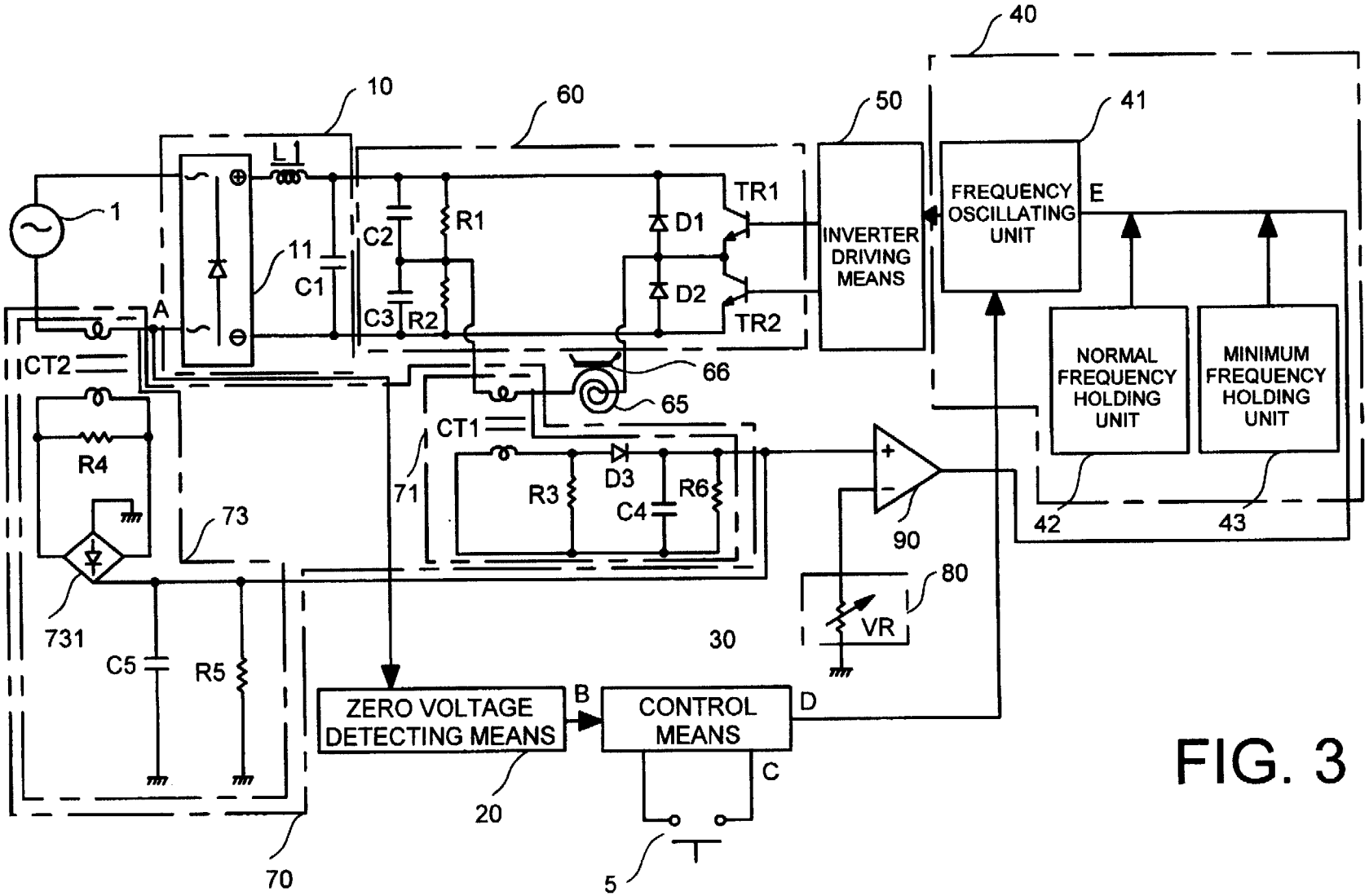
FIG. 3 is a detailed circuit diagram of an induction heating cooker according to an embodiment of the present invention.
Figures 4A, 4B, 4C, 4D, 4E, 4F, 4G:
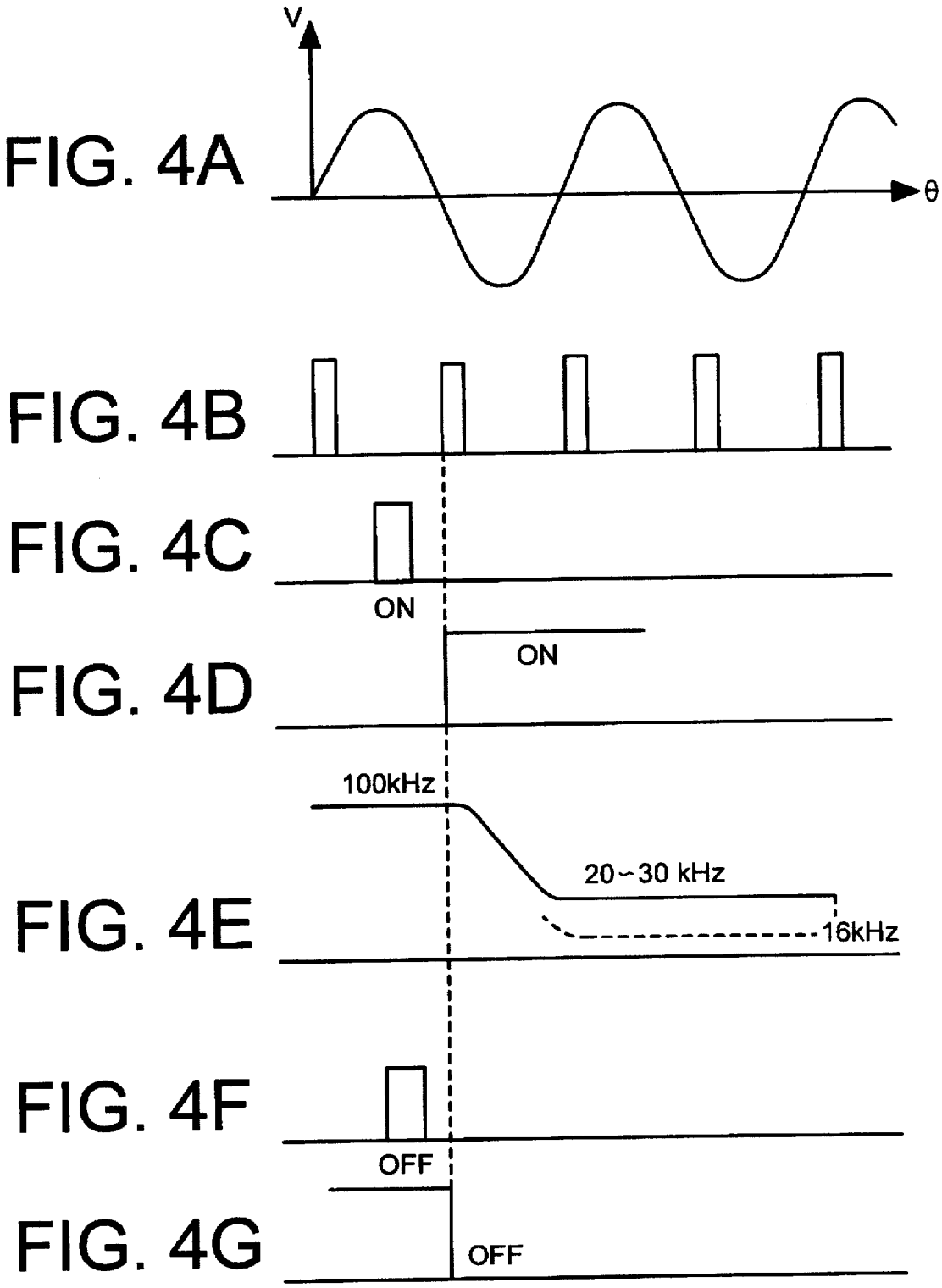

FIGS. 4A through 4G are output waveform diagrams at respective parts in FIG. 3, wherein, FIG. 4A is an AC input waveform diagram at a point "A" in FIG. 3, FIG. 4B is an output waveform diagram at a point "B" in FIG. 3, FIG. 4C is an output waveform diagram at a point "C" in FIG. 3 when the operation switch is turned on, FIG. 4D is an output waveform diagram at a point "D" in FIG. 3 when the operation switch is turned on, FIG. 4E is an output waveform diagram at point "E" in FIG. 3 when the operation switch is turned on, FIG. 4F is an output waveform diagram at the point "C" in FIG. 3 when the operation switch is turned off, and FIG. 4G is an output waveform diagram at the point ads in FIG. 3 when the operation switch is turned off.

Now, the operational effect of the induction heating cooker thus constructed will be described.

First of all, when power is applied to the induction heating cooker, a commercial AC input voltage shown as the waveform in FIG. 4A (AC input waveform diagram at the point "A" in FIG. 3) is supplied from the AC power input terminal 1 to the rectifying means 10.

The commercial AC voltage (waveform in FIG. 4A) applied to the rectifying means 10 is full wave rectified to a DC voltage through the bridge rectifier 11, and the ripple components contained in the DC voltage full wave rectified therefrom are filtered through the smoothing capacitor C1 and the DC voltage thus filtered is charged in the smoothing capacitor C1.

The voltage thus charged in the smoothing capacitor C1 is divided by voltage dividing resistors R1 and R2 of the inverter means 60 and given to the resonant capacitors C2 and C3 equally.

Meanwhile, a zero potential of the commercial AC voltage (waveform in FIG. 4A) supplied from the AC power input terminal 1 is detected by the zero voltage detecting means 20 which in turn outputs a zero voltage detecting signal indicated as the waveform in FIG. 4B (output waveform diagram at the point "B" in FIG. 3) to the control means 30.

At this time, when the user turns on the operation switch 5, a switch-on signal expressed as the waveform in FIG. 4C (output waveform diagram at the point "C" in FIG. 3) is supplied to the control means 30.

Accordingly, the control means 30 receives the zero voltage detecting signal (waveform in FIG. 4B) generated from the zero voltage detecting means 20 during input of the switch-on signal (waveform in FIG. 4C) and outputs to a frequency oscillating unit 41 and normal frequency holding unit 42 of the variable frequency oscillating means 40 a synchronous control signal expressed as the waveform in FIG. 4D (output waveform diagram at the point "D" in FIG. 3) so that the same can synchronize with the zero potential of the commercial AC voltage to thereby operate the induction heating cooker.

Subsequently, the frequency oscillating unit 41 receives a synchronous control signal (waveform in FIG. 4D) generated from the control means 30 to thereby generate an oscillating frequency for driving the heating coil 65.

The oscillating frequency generated by the frequency oscillating unit 41 is determined by the voltage indicated as the waveform in FIG. 4E (output waveform at the point "E" of FIG. 3) applied to the frequency oscillating unit 41 during input of the synchronous control signal (waveform in FIG. 4E) from the control means 30.

In other words, when the voltage (waveform in FIG. 4E) applied to the frequency oscillating unit 41 is increased, so does the oscillating frequency, and when the voltage (waveform in FIG. 4E) input to the frequency oscillating unit 41 is decreased, the oscillating frequency is also decreased, so that the variable oscillating frequency (approximately 20–30 KHz) is input to the inverter driving means 50.

At this time, the normal frequency holding unit 42 receives the synchronous control signal (waveform in FIG. 4D) to thereby decrease the voltage applied to the frequency oscillating unit 41 (the waveform in FIG. 4E) from a high level to a low level so that the oscillating frequency generated by the frequency oscillating unit 41 can maintain a normal frequency state.

When the oscillating frequency (approximately 20–30 KHz) generated from the frequency oscillating unit 41 is input to the inverter driving means 50, the inverter driving means 50 outputs a driving signal for driving the heating coil 65 to the inverter means 60 according to the oscillating frequency generated by the frequency oscillating unit 41.

Accordingly, the inverter means 60 receives at a base terminal of the switching elements TR1 and TR2 the driving signal output from the inverter driving means 50, to thereafter turn on or turn off the switching elements TR1 and TR2 alternatively.

When the switching element TR1 is turned on, the current flows to the resonant capacitor C3 through the switching element TR1 and via the heating coil 65 and the current transformer CT1 according to the voltage charged in the smoothing capacitor C1 of the rectifying means 10.

At this time, the resonant current supplied to the heating coil 65 increases as much as a time constant determined by the heating coil 65 and the resonant capacitor C3 but decreases afterwards, and the switching element TR1 is turned off at a point where the current intensity determined by the time constant comes to zero (0) and the switching element TR2 in turn is turned on.

When the switching element TP2 is rendered activated, the current generated by the voltage charged at the smoothing capacitor C1 of the rectifying means 10 flows to the switching element TR2 through the resonant capacitor C2 and via the current transformer CT1 and the heating coil 65.

At this time, the resonant current supplied to the heating coil 65 increases as much as a time constant determined by the heating coil 65 and the resonant capacitor C2 and decreases thereafter, and the switching element TR2 is rendered deactivated at a point where the current intensity determined by the time constant comes to zero (0) to thereby turn on the switching element TR1.

According to the alternating operations of activation and/or deactivation of the switching elements TR1 and TR2, a sine wave alternating current of approximately 20–30 KHz flows in the heating coil 65, by which an eddy current is generated on a surface of the cooking utensil 66 disposed on the heating coil 65 to thereby start to heat the cooking utensil 66.

Meanwhile, because half of the voltage charged in the smoothing capacitor C1 is respectively loaded at each of the resonant capacitors C2 and C3 during an initial activating operation of the switching elements TR1 and TR2, the surge current flowing at the resonant capacitors C2 and C3 should be reduced to thereby prevent the switching elements TR1 and TR2 and the heating coil 65 from being damaged.

At this time, resonant current intensity change varying in the course of the driving of the heating coil 65 according to the alternating operations of activation and/or deactivation of the switching elements TR1 and TR2 is detected by the current transformer CT1 of the resonant current detecting unit 71, and the resonant current intensity change detected therefrom is converted to a voltage intensity change by the resistor R3.

A voltage signal converted to the voltage intensity change by the resistor R3 is full wave rectified through the diode D3 and thereafter applied to a non-inverting terminal (+) of the comparison means 90.

Furthermore, the input current intensity change of the AC power input terminal 1 which changes in the course of the driving of the heating coil 65 according to the alternating operations of activation and/or deactivation of the switching elements TR1 and TR2 is detected by the current transformer CT2 of the input current detecting unit 73, and the input current intensity change detected therefrom is converted to a voltage intensity change through a resistor R4.

A voltage signal converted to the voltage intensity change by the resistor R4 is fullwave rectified to a DC voltage through a bridge rectifier 731, and then is input to a non-inverting terminal (+) of the comparison means 90 and at the same time, input to the control means 30.

Accordingly, the comparison means 90 receives at the non-inverting terminal (+) a voltage signal proportionate to the resonant current intensity change of the heating coil 65 detected by the resonant current detecting unit 71 and the input current intensity change of the AC power input terminal 1 detected by the input current detecting unit 73, and at the same time, receives at an inverting terminal (−) the reference voltage signal established by the load setting means 80 where the current limit is established, and compares the same.

The voltage signal compared by the comparison means 90 is fed back to the frequency oscillating unit 41 to thereby vary the oscillating frequency.

At this time, at the minimum frequency hold unit, the voltage signal input to the frequency oscillating unit 41 is prevented from being decreased lest the oscillating frequency should drop below an audible frequency when the comparison voltage signal varied by the comparison means 90 becomes too low, so that a minimum frequency as illustrated in FIG. 4E can be maintained.

Meanwhile, the control means 30 receives a voltage signal proportionate to the input current of the AC power input terminal 1 detected by the input current detecting unit 73, thereby discriminating whether the cooking utensil 66 disposed at the heating coil 65 is an appropriate load.

If the heating coil 65 is not disposed with the cooking utensil 66, or if the coil 65 is disposed with spoons, chopsticks or the like, a surge current flows momentarily in the switching elements TR1 and TR2. However the current intensity change input from the AC power input terminal 1 is small enough to be disregarded.

Accordingly, the input current detecting unit 73 detects a varying input current of the AC input terminal 1 through the current transformer CT2 to thereafter output the same to the control means 30.

Consequently, the control means 30 indicates through a display means (not shown) an operation error which shows that the cooking utensil 66 disposed at the heating coil 65 is not the appropriate utensil.

The control means 30 synchronizes with the zero potential of the commercial current voltage detected by the zero voltage detecting means 20 to thereby generate to the variable frequency oscillating means 40 a synchronous control signal indicated in the waveform at FIG. 4G (output waveform diagram at the point "D" in FIG. 3), so that operation of the induction heating cooker can be stopped for safe protection of circuits therein.

Furthermore, if the cooking utensil 66 disposed at the heating coil 65 is an aluminum cooking utensil or a non-metal cooking utensil, impedance becomes low to thereby increase the resonant current of the heating coil 65, which can be detected by the current transformer CT1 of the resonant current detecting unit 71 to thereafter be output to the comparison means 90.

The comparison means 90 compares the voltage signal proportionate to the resonant current detected by the resonant current detecting unit 71 with the reference voltage signal established by the load setting means 80 and outputs the varied voltage signal to the frequency oscillating unit 41.

Accordingly, the frequency oscillating unit 41 varies the oscillating frequency according to a state of the heating coil 65 by receiving the voltage signal varied by the comparison means 90.

The inverter driving means 50 outputs to the inverter means 60 a driving signal for driving the switching elements TR1 and TR2 according to the oscillating frequency varied by the frequency oscillating unit so that a stable electric power can be supplied even to a non-metal cooking utensil for the safe protection thereof.

When the user turns off the operating switch 5 during operation of the induction heating cooker thus described, a switch-off signal expressed in the waveform of FIG. 4F (output waveform diagram at the point "C" in FIG. 3) is applied to the control means 30.

Accordingly, the control means synchronizes with the zero potential of the commercial AC voltage by receiving the zero voltage detecting signal (waveform of the FIG. 4B) generated from the zero voltage detecting means 20 during input of the switch-off signal (waveform of FIG. 4F) to thereby output to the variable frequency oscillating means 40 a synchronous control signal indicated in the waveform of FIG. 4G (output waveform diagram in the point "D" of FIG. 3).

Consequently, the variable frequency oscillating means 40 receives the synchronous control signal output from the control means 30 to thereby stop the frequency oscillation.

When the frequency oscillation is stopped at the frequency oscillating means 40, the switching elements TR1 and TR2 are turned off because the driving signal is no longer generated from the inverter driving means 50 to the base terminals of the switching elements TR1 and TR2.

Accordingly, when the commerical AC voltage supplied from the AC power input terminal 1 is zero, the switching elements TR1 and TR2 are turned off, so that, when the current flowing in the switching elements TR1 and TR2 is minimum, the induction heating cooker is caused to stop for protection of the switching elements TR1 and TR2.

As apparent from the aforementioned description, according to the present invention of the induction heating cooker there is an advantage in that a current intensity change applied to a heating coil by current detecting means can be detected to thereby supply a predetermined resonant current to the heating coil during variation of the input power voltage for performance of the cooking, and surge current flowing in a resonant capacitor through switching elements during an initial operation of the induction heating cooker can be made small to thereby prevent breakage of the switching elements and the heating coil and to guarantee the safety thereof.

According to the present invention of the induction heating cooker, there is another advantage in that the resonant current flowing in the heating coil by a resonant current detecting unit can be detected, to thereby enable the oscillating frequency to be varied during use of a non-metal cooking utensil and to stabilize output power for safe driving of a product.

What is claimed is:

1. An induction heating cooker comprising:

rectifying means for full wave rectifying to a direct current voltage a commercial alternating current voltage input from an alternating current power input terminal;

zero voltage detecting means connected to the alternating current power input terminal for detecting a zero potential of the commercial alternating current voltage input from the alternating current power input terminal;

control means connected to the zero voltage detecting means for synchronizing with the zero potential of the commercial alternating current voltage detected by the zero voltage detecting means to thereby control the overall operations of the induction heating cooker;

variable frequency oscillating means connected to the control means for receiving a control signal generating by the control means to thereby generate an oscillating frequency;

inverter driving means connected to the variable frequency oscillating means for generating a driving signal according to the oscillating frequency generated by the variable frequency oscillating means;

inverter means for receiving the direct current voltage generated from the rectifying means responsive to the driving signal of the inverter driving means to thereby generate a high frequency wave, the inverter means comprising:

a first switching element and a second switching element connected to the inverter driving means for receiving the driving signal output from the inverter driving means to thereby turn on and turn off alternatively, a heating coil having one side connected to an emitter of the first switching element for receiving a turn on signal from the first switching element to thereby generate an eddy current, a first resonant capacitor connected to the heating coil in parallel for receiving the turn on signal of the first switching element through the heating coil to thereby form a voltage source while charging and discharging, and a second resonant capacitor connected to the heating coil for receiving a turn on signal from the second switching element to thereby generate a voltage source while charging and discharging;

current detecting means for detecting a current intensity change applied to the heating coil to thereby supply a predetermined intensity of resonant current to the heating coil driven by the inverter means; and comparison means for comparing an input current intensity change of the heating coil detected by the current detecting means with a predetermined reference current intensity to thereby generate a comparison voltage signal which is sent to the variable frequency oscillating means to vary the oscillating frequency;

further comprising first and second resistors connected in parallel to the first and second resonant capacitors for decreasing by about half the voltage across the first and second resonant capacitors.

2. The induction heating cooker of claim 1, wherein the current detecting means comprises resonant current detecting means for detecting by a resonant current intensity whether a cooking utensil disposed on the heating coil is a non-metal cooking utensil or an aluminum cooking utensil.

3. An induction heating cooker, comprising:

a heating coil;

rectifying means for rectifying an input alternating current to a direct current;

input current detecting means for detecting a current intensity of the input alternating current and for generating a first voltage signal based on the detected intensity of the input alternating current;

resonant current detecting means for detecting a resonant current intensity in the heating coil and for generating a second voltage signal based on the detected resonant current intensity;

a comparator which receives a signal responsive to the first and second voltage signals and compares the signal to a reference voltage signal to output a third voltage signal;

variable frequency oscillating means for generating and varying an oscillating frequency responsive to the third voltage signal output from the comparator; and inverter means for receiving the direct current from the rectifying means and for driving the heating coil responsive to the oscillating frequency, wherein the inverter means comprises first and second switching elements which are switched on and off responsive to the oscillating frequency, and first and second resonant capacitors connected to the heating coil which receive a turn on signal from the first and second switching elements, respectively, through the heating coil, further including first and second resistors connected in parallel to the first and second resonant capacitors for decreasing by about half the voltage across the first and second resonant capacitors.

* * * * *